US012692777B2

(12) United States Patent
Nguyen et al.

(10) Patent No.: US 12,692,777 B2
(45) Date of Patent: Jul. 28, 2026

(54) METHODS OF FORMING AND MAINTAINING CONDUCTIVE PROPPED FRACTURES IN SAGD AND GEOTHERMAL WELL APPLICATIONS

(71) Applicant: Halliburton Energy Services, Inc., Houston, TX (US)

(72) Inventors: Philip D. Nguyen, Houston, TX (US); Ronald Glen Dusterhoft, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/960,701

(22) Filed: Nov. 26, 2024

(65) Prior Publication Data

US 2026/0146523 A1 May 28, 2026

(51) Int. Cl.
*E21B 43/267* (2006.01)
*E21B 43/24* (2006.01)

(52) U.S. Cl.
CPC ..... *E21B 43/267* (2013.01); *E21B 43/2405* (2013.01); *E21B 43/2408* (2013.01)

(58) Field of Classification Search
CPC ..... E21B 43/267; E21B 43/2405; E21B 43/24
See application file for complete search history.

(56) References Cited

U.S. PATENT DOCUMENTS 7,281,581 B2 10/2007 Nguyen et al.
7,461,696 B2 12/2008 Nguyen et al.
7,500,519 B2 3/2009 Weaver et al.
7,571,767 B2 8/2009 Parker et al.
7,581,590 B2 9/2009 Lesko et al.
7,591,313 B2 9/2009 Weaver et al.
7,794,537 B2 9/2010 Barlet-Gouedard et al.
9,279,077 B2 3/2016 Liang et al.
(Continued)

OTHER PUBLICATIONS

M.G. Reed, Gravel Pack and Formation Sandstone Dissolution During Steam Injection Chevron Oil Field Research Co. Journal of Petroleum Technology, Jun. 1980, pp. 941-949.
(Continued)

*Primary Examiner* — Crystal J Lee
(74) *Attorney, Agent, or Firm* — Conley Rose, P.C.; Rodney B. Carroll

(57) ABSTRACT

A method of forming propped fractures in a subterranean formation penetrated by a wellbore is provided. The method includes injecting a fracturing fluid through a (e.g., geothermal, SAGD) wellbore into the subterranean formation, thus creating fractures in the subterranean formation, whereby the aggregates and dissolvable particulates are positioned in the created fractures. The fracturing fluid comprises a carrier fluid; aggregates; and dissolvable particulates (e.g., proppant, sand; that dissolves over time under downhole conditions, e.g., T≥230° C.). The method further includes allowing the aggregates to cure into hardened masses (e.g., for functioning as pillars); and dissolving the dissolvable particulates, whereby voids and/or (e.g., solids-free) channels are formed in the (e.g., highly conductive) propped fractures, wherein the voids and/or channels (e.g., surround the solid masses and) provide pathways (e.g., for fluid to flow) through the (e.g., highly conductive) propped fractures (e.g., from the wellbore to another wellbore).

10 Claims, 3 Drawing Sheets

(56) References Cited

U.S. PATENT DOCUMENTS

| | | | | |
|---|---|---|---|---|
| 11,041,111 | B2 | 6/2021 | Nguyen et al. | |
| 11,286,761 | B2 | 3/2022 | Nguyen et al. | |
| 11,345,848 | B2 | 5/2022 | Khamatnurova et al. | |
| 2006/0113080 | A1* | 6/2006 | Nguyen | C09K 8/703 166/308.1 |
| 2008/0028994 | A1 | 2/2008 | Barlet-Gouedard et al. | |
| 2008/0135242 | A1* | 6/2008 | Lesko | C09K 8/72 166/280.1 |
| 2012/0247765 | A1* | 10/2012 | Agrawal | C09K 8/80 507/272 |
| 2014/0131041 | A1* | 5/2014 | Liang | C09K 8/805 166/280.2 |
| 2019/0106619 | A1* | 4/2019 | Nguyen | E21B 21/003 |

OTHER PUBLICATIONS

D.R. Underdown, Stability of Gravel-Packing Materials for Thermal Wells, Society of Petroleum Engineers, Journal of Petroleum Technology, 2006 pp. 2006-2012.

J.D. Weaver, Evaluation of Steam Resistance of Gravel-Packing Materials, SPE Production Engineering, May 1992. pp. 155-159.

Jim Weaver, Fracture-Related Diagenesis May Impact Conductivity, SPE 98236, International Symposium and Exibition on Formation Damage Control, Lafayette, LA Feb. 15-17, 2006. pp. 272-281.

Jim Weaver,Fracture-Conductivity Loss Caused by Geochemical Interactions Between Man-Made Proppants and Formations,SPE Mar. 2010, pp. 116-124.

Neelam Raysoni, Long-Term Hydrothermal Proppant Performance, SPE International Symposium and Exhibition on Formation Damage Control, Lafayette, Louisiana, USA. Feb. 2012. pp. 414- 426.

Nevil Kunneth Aven, Long-Term Dynamic Flow Testing of Propants, SPE International Symposium on Oilfield Chemistry held in The Woodlands, Texas, USA. Apr. 8-10, 2013. 19 pages.

Abhinav Mittal, Proppant-Conductivity Testing Under Simulated Reservoir Conditions: Impact of Crushing, Embedment, and Diagenesis on Long-Term Production in Shales. SPE/AAPG/SEG Unconventional Resources Technology Conference, Austin, Texas, USA, Jul. 24-26, 2017. pp. 1304-1315. 1315.

Ahmed M. Alsarawy, Proppant Diagenesis in Carbonate-Rich Eagle Ford Shale Fractures, SPE Drilling & Completion, Sep. 2020. pp. 465-477.

Lois L. Mccorriston, Study of Reservoir Damage Produced in Heavy Oil Formations Due to Steam Injection, SPE 10077. 11 pages.

* cited by examiner

METHODS OF FORMING AND MAINTAINING CONDUCTIVE PROPPED FRACTURES IN SAGD AND GEOTHERMAL WELL APPLICATIONS

CROSS-REFERENCE TO RELATED APPLICATIONS

None.

STATEMENT REGARDING FEDERALLY SPONSORED RESEARCH OR DEVELOPMENT

Not applicable.

BACKGROUND

The present disclosure relates generally to methods of forming conductive propped fractures in well applications; more specifically, this disclosure relates to methods of forming conductive propped fractures in wells such as steam assisted gravity drainage (SAGD) and/or geothermal well applications; yet more specifically, this disclosure relates to methods of forming conductive propped fractures in (e.g., steam assisted gravity drainage (SAGD) and/or geothermal) well applications via the use of fly ash composites and/or geopolymer compositions.

BRIEF DESCRIPTION OF THE DRAWINGS

Illustrative examples of the present disclosure are described in detail below with reference to the attached drawing figures, which are incorporated by reference herein, wherein like reference numerals represent like parts and wherein.

Figure 1:
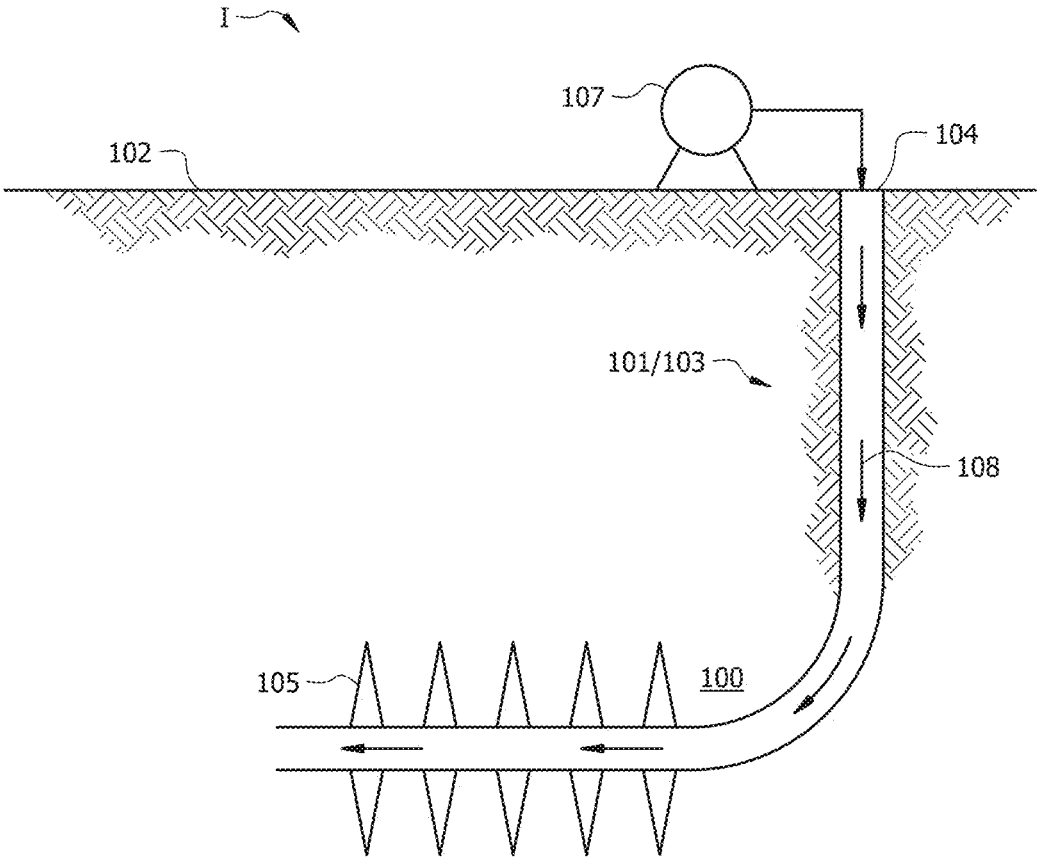
FIG. 1 is a schematic of a system I, according to embodiments of this disclosure.

The illustrated figures are only exemplary and are not intended to assert or imply any limitation with regard to the environment, architecture, design, or process in which different examples may be implemented.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

It should be noted that when "about" is used herein at the beginning of a numerical list, "about" modifies each number of the numerical list. Further, in some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, particle sizes, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the illustrative embodiments described herein. At the very least, and not as an attempt to limit the application of the doctrine of equivalents to the scope of the claim, each numerical parameter should at least be construed in light of the number of reported significant digits and by applying ordinary rounding techniques. The term "about" as used herein can thus allow for a degree of variability in a value or range, for example, within 10%, within 5%, or within 1% of a stated value or of a stated limit of a range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more.

The term "downhole" as used herein refers to under the surface of the earth, such as a location within or fluidly connected to a wellbore.

If there is any conflict in the usages of a word or term in this specification and one or more patent or other documents that may be incorporated herein by reference, the definitions that are consistent with this specification should be adopted.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

In the following discussion and in the claims, the terms "including" and "comprising" are used in an open ended fashion, and thus should be interpreted to mean "including, but not limited to." Unless otherwise indicated, as used throughout this document, "or" does not require mutual exclusivity.

The terms uphole and downhole can be used to refer to the location of various components relative to the bottom or end of a well. For example, a first component described as uphole from a second component can be further away from the end of the well than the second component. Similarly, a first component described as being downhole from a second component can be located closer to the end of the well than the second component.

Exposure of natural sand or man-made proppant to elements such as high temperature water (e.g., steam), high pressure and stress can cause these materials to deteriorate with time. High temperatures and high closure stresses in the presence of water can cause dissolution of sand and man-made proppant, thereby causing drastic reduction of propped fracture conductivity. Propped fractures in various wells, such as in geothermal wells and SAGD wells, are typically exposed to some or all of such conditions/elements. Flowback of proppant or proppant debris from propped fractures into a wellbore, caused by fluid drag force, can potentially cause damage to downhole and surface equipment.

Rather than relying on conventional natural sand or high-strength, man-made proppant for mechanically supporting fractures of such wells (e.g., SAGD or geothermal wells), this disclosure, in embodiments, provides methods for forming and maintaining conductive propped fractures by placing a combination of a fly ash composite or geopolymer composition and dissolvable particulate (e.g., natural sand) in the propped fractures; wherein the fly ash composite or geopolymer composition is treated with (e.g., comprises) a binding agent for forming aggregates that consolidate into high strength nodes or pillars to withstand conditions (e.g., high temperatures and high stresses) in geothermal environments, while the exposed natural sand is allowed to dissolve by exposure to downhole conditions (e.g., steam) with time and thus form conductive flow paths. Thereby, the formed conductive flow paths allow fluids to flow through the propped fractures (e.g., to a(nother) wellbore), while preventing flowback of solids from the propped fractures. Protected dissolvable (e.g., sand or silica) particles that are encased within the geopolymer materials can provide enhanced mechanical support by acting as an aggregate.

Description of a method of this disclosure will now be made with reference to FIG. 1, which is a schematic of a system I comprising a wellbore and propped fractures, wherein the propped fractures are produced via the method. A method of forming (e.g., highly conductive) propped fractures 105 in a subterranean formation 100 penetrated by a wellbore 101/103 (as described further with reference to FIG. 2 and FIG. 3 hereinbelow) can comprise: injecting (e.g., pumping) a fracturing fluid 108 through a (e.g., geothermal, SAGD) wellbore 101/103 into the subterranean formation 100, thus creating fractures 105 in the subterranean formation 100, whereby aggregates and dissolvable particulates in the fracturing fluid 108 are positioned in the created fractures 105; allowing the aggregates to cure into hardened masses (e.g., for functioning as pillars); and dissolving the dissolvable particulates, whereby voids and/or (e.g., solids-free) channels are formed in the (e.g., highly conductive) propped fractures 105. The voids and/or channels (e.g., surround the solid masses and) provide pathways (e.g., for fluid to flow) through the (e.g., highly conductive) propped fractures 105 (e.g., from the wellbore (e.g., wellbore 101/103) to another wellbore (e.g., 103/101)). The fracturing fluid 108 can comprise: a carrier fluid; the aggregates; and the dissolvable particulates.

The dissolvable particulates can comprise, for example, a proppant, such as sand, that dissolves over time under downhole conditions, such as superheat, for example with a temperature of greater than or equal to about 230° C. (e.g., steam can be generated with pH increases potentially to above 12 as a result of minerals dissolved from rock formation). For example, in embodiments, the dissolvable particulates comprise (e.g., natural) sand. For example, rock formations can contain various amounts of bicarbonate ($HCO_3^-$) or carbonate ($CO_3^{-2}$) dissociated from, for example, sodium bicarbonate ($NaHCO_3$) or sodium carbonate ($Na_2CO_3$), respectively, when steam is introduced. Thermal degradation of $HCO_3$ can produce carbon dioxide ($CO_2$) and hydroxide ions (OH_). The $CO_2$ can tend to partition to vapor phase, while the $OH^-$ can remain in the liquid phase of the steam, producing a high pH in the liquid phase; this alkaline solution can readily dissolve dissolvable particulates, such as natural sand.

The aggregate slurry comprises the aggregates, which can be selected from aggregates of fly ash composite, aggregates of geopolymer, or a combination thereof. As utilized herein, "aggregate" refers to a material comprising a (e.g., loosely compacted) mass of fragments or particles. Thus, aggregates of fly ash can comprise a (e.g., loosely compacted) mass of fragments or particles of fly ash, while aggregates of geopolymer can comprise a (e.g., loosely compacted) mass of fragments or particles of geopolymer. That is, individual particulates that cluster together can be referred to herein as "aggregates". The aggregates of fly ash composite can comprise fly ash, cement, and a binding agent. The aggregates of geopolymer can comprise a geopolymer composition and a binding agent. In embodiments, the aggregates of fly ash composite comprise fly ash, cement, and a binding agent and the aggregates of geopolymer comprise a geopolymer composition and a binding agent. In embodiments, the aggregate slurry can include aggregates of fly ash composite comprising fly ash, cement, and a binding agent and aggregates of geopolymer comprising a geopolymer composition and a binding agent.

The binding agent can comprise a flocculating agent ("flocculant"), a surface modification agent (a "surface modifier"), an adhesive material, a curing agent, or a combination thereof. The flocculating agent can be selected from lime, calcium chloride, ferric chloride, aluminum sulfate, polyethylene glycol, polyacrylamide, polyamines, or a combination thereof.

The fly ash (e.g., in the fly ash composite) can comprises ASTM Class C fly ash, ASTM Class F fly ash, or a combination thereof. The method can further include forming the fly ash composite by combining the fly ash with cement, pozzolan, or a combination thereof. The cement can comprise any cement, such as, for example, a Portland cement. Forming the fly ash composite by combining the fly ash with cement, pozzolan, or the combination thereof can further comprise combining the fly ash with cement, pozzolan, or the combination thereof and a binding agent. In some such embodiments, the binding agent can be a curing agent selected from calcium hydroxide, sodium hydroxide, potassium hydroxide, sodium silicate, sulfuric acid, phosphoric acid, polyphosphoric acid, phosphoric acid precursor (e.g., orthophosphates, pyrophosphate, metaphosphate, polyphosphate), salts thereof (e.g., sodium dihydrogen phosphate, dipotassium hydrogen phosphate, tricalcium phosphate), or a combination thereof.

The geopolymer composition can comprise an aluminosilicate (source), a metal silicate (source), and an activator. In embodiments, the aluminosilicate comprises fly ash.

The carrier fluid can comprise a slick water or a gel. In embodiments, the carrier fluid comprises a crosslinked gel, a viscoelastic surfactant gel, an oil gel, a foamed gel, and/or an emulsion.

The propped fractures 105 can be highly conductive propped fractures 105 that maintain porosity (flow) at closing pressures of greater than or equal to about 10000, 9000, 8000, 7000, 6000, 5000, or 4000 psi.

Figure 2:
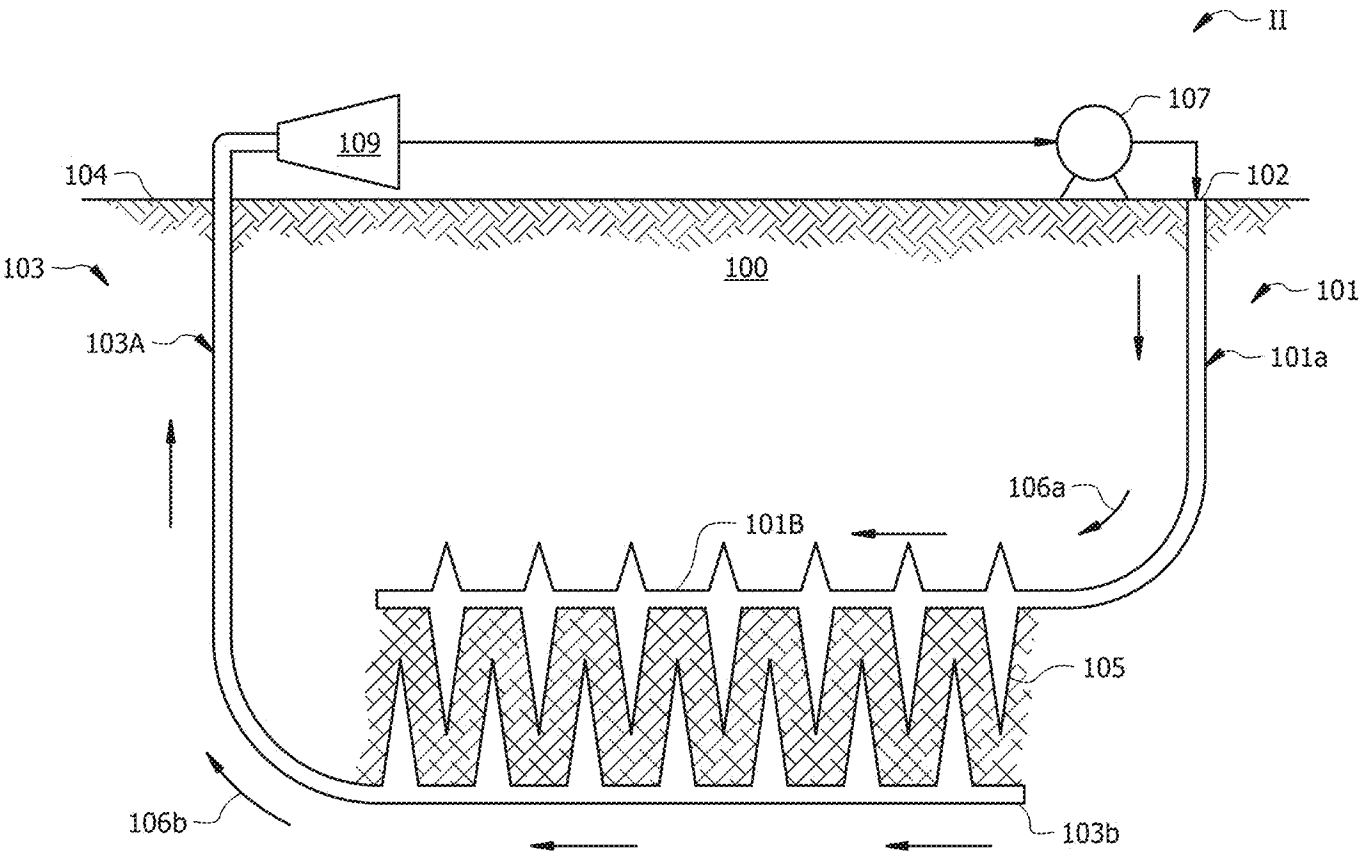
FIG. 2 is a schematic of a system II, according to embodiments of this disclosure.
Figure 3:
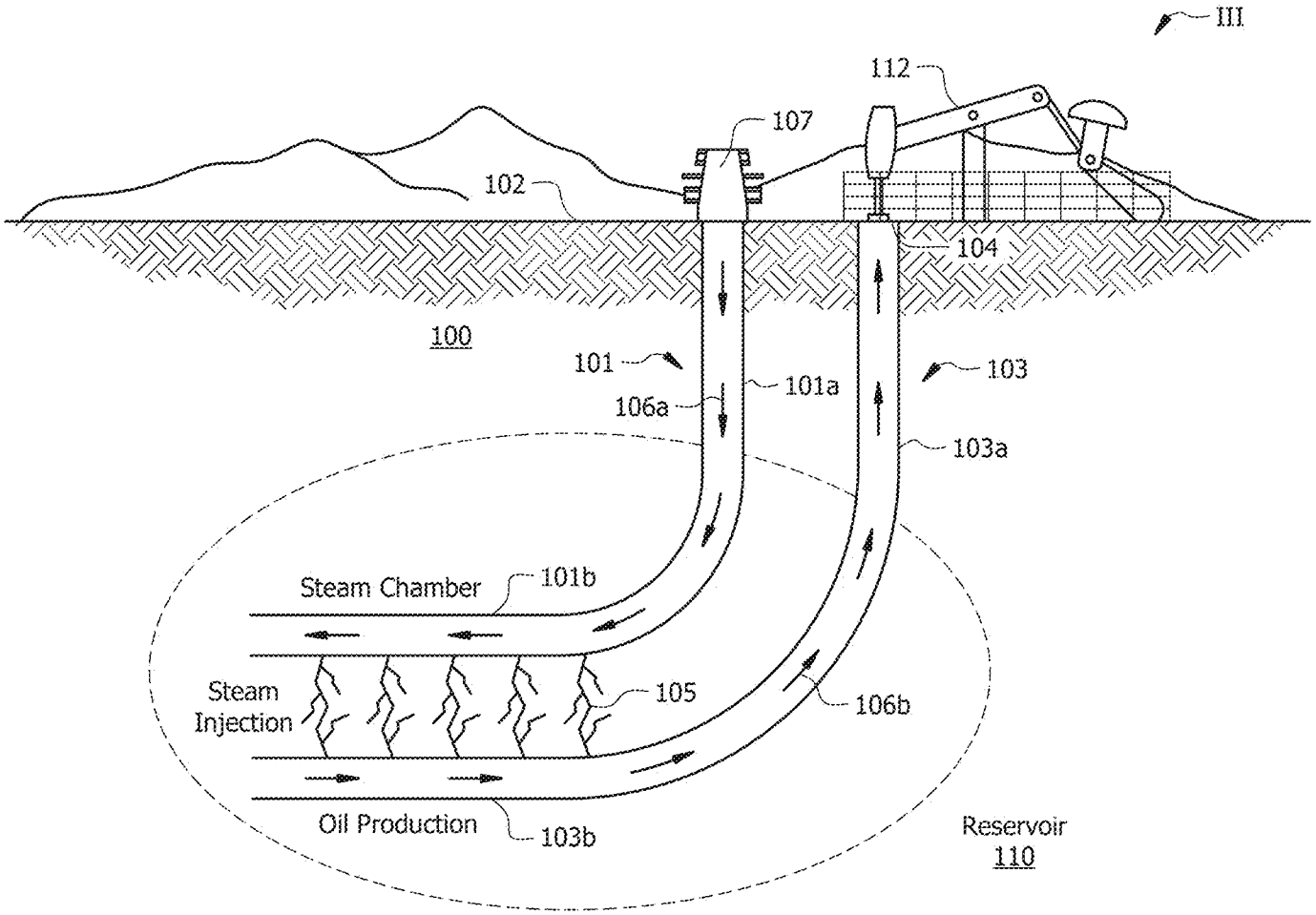
FIG. 3 is a schematic of a system III, according to embodiments of this disclosure.

The method can further comprise carrying out a steam assisted gravity drainage (SAGD) or geothermal process utilizing the wellbore, as described further hereinbelow with reference to FIG. 2 and FIG. 3. In embodiments, after injecting the fracturing fluid to position the aggregates and dissolvable particulates in the created fractures 105 and allowing the aggregates to harden, the dissolving of the dissolvable particulates can be effected at least in part during injection of steam during the SAGD process or during injection of steam or another heat exchange fluid into the wellbore 101 during the geothermal process.

Also disclosed herein is a method of forming propped (e.g., highly conductive) fractures 105 in a subterranean formation 100 penetrated by a wellbore (101/103), the method comprising: providing an aggregate slurry and a dissolvable particulate (e.g., sand; dissolvable at downhole conditions, e.g., with time, temperature, water) slurry; alternately (e.g., and/or intermittently) injecting volumes of the aggregate slurry and the dissolvable particulate slurry into the formation 100 (e.g., via a (e.g., SAGD or geothermal wellbore)), whereby the aggregates and dissolvable particulates are positioned in created fractures 105; curing the aggregates (e.g., allowing the aggregates to cure) into hardened masses (e.g., for functioning as pillars); and dissolving some or all of the dissolvable particulates to form voids and/or (e.g., solids-free) channels in the (e.g., highly conductive) propped fractures 105, wherein the voids and/or channels (e.g., surround the solid masses and) provide pathways (e.g., for fluid to flow) through the (e.g., highly conductive) propped fractures (e.g., from the wellbore 101/103 to another wellbore 103/101). As discussed further hereinbelow, dissolving can comprise waiting a sufficient time for downhole conditions to dissolve the dissolvable particulates, and/or can be facilitated, for example via the injection of steam during a SAGD process or during injection of steam or another heat exchange fluid into the wellbore during a geothermal process, as elaborated hereinbelow.

The dissolvable particulates can comprise (e.g., natural) sand. The aggregates can be selected from aggregates of fly ash composite, aggregates of geopolymer, or a combination thereof. The aggregates of fly ash composite can comprise fly ash, cement, and a binding agent. The aggregates of geopolymer can comprise a geopolymer composition and a binding agent. In embodiments, the aggregate slurry can include aggregates of fly ash composite comprising fly ash, cement, and a binding agent and aggregates of geopolymer comprising a geopolymer composition and a binding agent. The binding agent can comprise a flocculating agent ("flocculant"), a surface modification agent (a "surface modifier"), an adhesive material, a curing agent, or a combination thereof. The flocculating agent can be selected from lime, calcium chloride, ferric chloride, aluminum sulfate, polyethylene glycol, polyacrylamide, polyamines, or a combination thereof.

The fly ash can comprise ASTM Class C fly ash, ASTM Class F fly ash, or a combination thereof. The method can further include forming the fly ash composite by combining the fly ash with cement, pozzolan, or a combination thereof. The cement can comprise any cementitious material, for example, a Portland cement. Forming the fly ash composite by combining the fly ash with cement, pozzolan, or the combination thereof can further comprise combining the fly ash with cement, pozzolan, or the combination thereof and a binding agent. In some such embodiments, the binding agent can be a curing agent selected from calcium hydroxide, sodium hydroxide, potassium hydroxide, sodium silicate, sulfuric acid, phosphoric acid, polyphosphoric acid, phosphoric acid precursor (e.g., orthophosphates, pyrophosphate, metaphosphate, polyphosphate), salts thereof (e.g., sodium dihydrogen phosphate, dipotassium hydrogen phosphate, tricalcium phosphate) or a combination thereof.

As noted above, the geopolymer composition utilized in the method can comprise an aluminosilicate (source), a metal silicate (source), and an activator. In embodiments, the aluminosilicate comprises fly ash.

The aggregate slurry can further comprise a carrier fluid that comprises a slick water or a gel. The gel can comprise a crosslinked gel, a viscoelastic surfactant gel, an oil gel, a foamed gel, and/or an emulsion.

The propped fractures 105 can be highly conductive propped fractures that maintain porosity (flow) at closing pressures of greater than or equal to about 10000, 9000, 8000, 7000, 6000, 5000, or 4000 psi.

The method can further comprise carrying out a steam assisted gravity drainage (SAGD) or geothermal process utilizing the wellbore 101/103, as described further hereinbelow with reference to FIG. 2 and FIG. 3. The dissolving of the some or all of the dissolvable particulates can be effected at least in part during injection of steam during the SAGD process or during injection of steam or another heat exchange fluid into the wellbore during the geothermal process.

Also disclosed herein is a method of forming propped (e.g., highly conductive) fractures in a subterranean formation 100 penetrated by a wellbore 101/103, the method comprising: injecting a fracturing fluid 108 comprising a carrier fluid and aggregates into the subterranean formation 100 (e.g., via a (e.g., SAGD or geothermal) wellbore) whereby propped fractures 105 are created; wherein the fracturing fluid comprises from about 0.1 to about 0.5, from about 0.1 to about 0.4, or from about 0.1 to about 0.3 pounds per gallon of the aggregates, and wherein the aggregates (are clusters of micro-proppants that) have a size (e.g., a median size, a volume average size, a D50) of about 20, 100, or 1000 micrometers (μm)); and wherein the aggregates accumulate at fracture joints or branches and/or points of leak-off (e.g., such as fracture throats, fracture joints or fracture intersections, permeable streaks in the rock or natural fractures in the rock) of the subterranean formation 100; and allowing the aggregates to cure (e.g., into hardened masses). For example, a single micro-proppant can have a particle size of 5 to 25 microns; while a cluster or an aggregate of micro-proppant can be much larger than the individual particle size.

In some such embodiments, the fracturing fluid 108 can further comprise dissolvable particulates (e.g., proppant, sand) having a size (e.g., a median size, a volume average size, a D50) of less than or equal to about 50 to 1000 micrometers (μm). The method can further comprise dissolving some or all of the dissolvable particulates to form voids and/or (e.g., solids-free) channels in the (e.g., highly conductive) propped fractures 105, wherein the voids and/or channels (e.g., surround the solid masses and) provide pathways for fluid to flow through the (e.g., highly conductive) propped fractures (e.g., from the wellbore (e.g., wellbore 101) to another wellbore (e.g., wellbore 103 described hereinbelow)). The dissolvable particulates can comprise (e.g., natural) sand. Dissolving the dissolvable particulates can be effected at least in part during injection of steam during a SAGD process or during injection of steam or another heat exchange fluid into the wellbore 101/103 during a geothermal process, as described further hereinbelow with reference to FIG. 2 and FIG. 3.

The aggregates can be selected from aggregates of fly ash composite, aggregates of geopolymer, or a combination thereof. The aggregates of fly ash composite can comprise fly ash, cement, and a binding agent. The aggregates of geopolymer can comprise a geopolymer composition and a binding agent. In embodiments, the fracturing fluid can include aggregates of fly ash composite comprising fly ash, cement, and a binding agent, and aggregates of geopolymer comprising a geopolymer composition and a binding agent. In some such embodiments, the binding agent can comprise a flocculating agent ("flocculant"), a surface modification agent (a "surface modifier"), an adhesive material, a curing agent, or a combination thereof. The flocculating agent can be selected from lime, calcium chloride, ferric chloride, aluminum sulfate, polyethylene glycol, polyacrylamide, polyamines, or a combination thereof.

The fly ash can comprise ASTM Class C fly ash, ASTM Class F fly ash, or a combination thereof. The method can further comprise forming the fly ash composite by combining the fly ash with cement, pozzolan, or a combination thereof. The cement can comprise any cementitious material, for example, a Portland cement. Forming the fly ash composite by combining the fly ash with cement, pozzolan, or the combination thereof can further comprise combining the fly ash with cement, pozzolan, or the combination thereof and a binding agent. In some such embodiments, the binding agent can be a curing agent selected from calcium hydroxide, sodium hydroxide, potassium hydroxide, sodium silicate, sulfuric acid, phosphoric acid, polyphosphoric acid, phosphoric acid precursor (e.g., orthophosphates, pyrophosphate, metaphosphate, polyphosphate), salts thereof (e.g., sodium dihydrogen phosphate, dipotassium hydrogen phosphate, tricalcium phosphate), or a combination thereof.

As noted hereinabove, the geopolymer composition utilized in the method can comprise an aluminosilicate (source), a metal silicate (source), and an activator. In embodiments, the aluminosilicate comprises fly ash.

The carrier fluid can comprise a slick water or a gel. The gel can include a crosslinked gel, a viscoelastic surfactant gel, an oil gel, a foamed gel, and/or an emulsion.

The propped fractures 105 can be highly conductive propped fractures 105 that maintain porosity (flow) at closing pressures of greater than or equal to about 10000, 9000, 8000, 7000, 6000, 5000, or 4000 psi. The method can further comprise: carrying out a SAGD or geothermal process utilizing the wellbore, as described hereinbelow with reference to FIG. 2 and FIG. 3, respectively.

In embodiments, the method of this disclosure can further include carrying out a SAGD or geothermal process utilizing the wellbore 101/103 comprising the highly conductive propped fractures produced as disclosed hereinabove. For example, FIG. 2 is a schematic diagram illustrating a system II of wellbores and propped fractures in a subterranean formation, in accordance with certain embodiments of the present disclosure, that can be utilized to carry out a geothermal process. The subterranean formation 100 includes an injection wellbore 101 that has been drilled from a location 102 at the surface to penetrate at least a portion of the formation 100. As shown, injection wellbore 101 includes at least one substantially vertical portion 101*a* extending from the surface at location 102 and at least one substantially horizontal portion 101*b* that extends from the bottom of the vertical portion 101*a*. Further, the injection wellbore 101 may be coupled to an injection pump 107. The subterranean formation 100 also includes a production wellbore 103 that has been drilled from the surface 104 to penetrate at least a portion of the formation 100. As shown, production wellbore 103 includes at least one substantially vertical portion 103*a* extending from location 104 at the surface and at least one substantially horizontal portion 103*b* that extends from the bottom of the vertical portion 103*a*. The production wellbore 103 may be coupled to an electricity generator 109, for example and without limitation, a turbine.

In embodiments, the horizontal portion 103*b* of the production wellbore 103 may be parallel to the horizontal portion 101*b* of the injection wellbore 101. In some embodiments, the horizontal portions 103*b* and 101*b* of the injection wellbore 103 and the injection wellbore 101*b* may be within a range of 50 to 1000 feet of one another.

In embodiments, the fractures 105 can be created and/or propped via both the injection wellbore 101 and the production wellbore 103. In embodiments, the fractures 105 can be created in parallel to one another. In embodiments, the fractures 105 can be created such that each primary fracture generated by one wellbore is located between, or in close proximity to, two primary fractures generated by the other wellbore. In embodiments, a fracturing fluid and/or method as described hereinabove can be used to create and/or prop one or more highly conductive fractures 105 of injection wellbore 101 and/or production wellbore 103.

In embodiments, for a geothermal application, an injection fluid 106*a* can be injected into an injection wellbore 101 and can travel to one or more propped fractures 105 to absorb heat in the rock formation. Subsequently, a produced fluid (e.g., a high-temperature fluid) 106*b* can travel from the propped fractures 105 to a production wellbore 103 for production. In embodiments, the produced fluid (e.g., the high-temperature fluid) can then be used to generate electricity. For example and without limitation, the high-temperature produced fluid can be routed through one or more turbo-expanders, wherein the effluent fluids discharged from the turbo-expanders can pass through a heat exchanger and be recycled to the injection wellbore 101.

In embodiments, the method of this disclosure can further include carrying out a SAGD process utilizing the wellbore 101/103 comprising the highly conductive propped fractures 105 produced as disclosed hereinabove. For example, FIG. 3 is a schematic diagram illustrating a system III of wellbores and propped fractures in a subterranean formation, in accordance with certain embodiments of the present disclosure, that can be utilized to carry out a SAGD process. In such embodiments, the subterranean formation 100 can include an injection wellbore 101 that has been drilled from a location 102 at the surface to penetrate at least a portion of the formation 100. As shown, injection wellbore 101 includes at least one substantially vertical portion 101*a* extending from the surface at location 102 and at least one substantially horizontal portion 101*b* that extends from the bottom of the vertical portion 101*a*. Further, the injection wellbore 101 may be coupled to an injection pump 107. The subterranean formation 100 also includes a production wellbore 103 that has been drilled from the surface 104 to penetrate at least a portion of the formation 100. As shown, production wellbore 103 includes at least one substantially vertical portion 103*a* extending from location 104 at the surface and at least one substantially horizontal portion 103*b* that extends from the bottom of the vertical portion 103*a*. The production wellbore 103 may be coupled to an oil production apparatus 112, configured for producing the oil 106*b* from production wellbore 103.

In embodiments, the horizontal portion 103*b* of the production wellbore 103 may be parallel to the horizontal portion 101*b* of the injection wellbore 101. In embodiments, the horizontal portions 103*b* and 101*b* of the injection wellbore 103 and the injection wellbore 101*b*, respectively, may be within a range of 50 to 1000 feet of one another.

In embodiments, the fractures 105 can be created and/or propped via both the injection wellbore 101 and the production wellbore 103. In embodiments, the fractures 105 can be created in parallel to one another. In embodiments, the fractures 105 can be created such that each primary fracture generated by one wellbore is located between, or in close proximity to, two primary fractures generated by the other wellbore.

In embodiments, a fracturing fluid and/or method as described hereinabove with reference to FIG. 1 can be used to create and/or prop one or more highly conductive fractures 105.

In embodiments, for a SAGD process, an injection fluid 106*a* comprising steam can be injected into an injection wellbore 101 and can travel to one or more propped fractures 105 to heat hydrocarbons in the rock formation 100. Subsequently, a produced fluid (e.g., oil/hydrocarbons) 106*b* can travel from the propped fractures 105 to a production wellbore 103 for production. In embodiments, the produced fluid (e.g., the oil/hydrocarbons) can then be produced via oil production apparatus 112.

Fly ash is a waste byproduct from coal combustion which is readily available at low cost. In embodiments of this disclosure, fly ash can be utilized as a (e.g., primary) aluminosilicate source in the geopolymer composition. When mixed with Portland cement and/or other binding materials, fly ash can improve the thermal resistance of the overall matrix, allowing the cured composite to maintain integrity under the high-temperature conditions found in some (e.g., SAGD or geothermal) wells. Via this disclosure, fly ash composite and/or geopolymer composition can be cured into high strength mass to function as pillars in keeping the fractures open. Pillars formed from aggregates of fly ash composite and/or geopolymer composition can withstand high-temperature, high-stress, and corrosive environments to maintain the conductivity of the propped fractures in (e.g., SAGD and geothermal) wells during their cycles of fluid (e.g., steam) injection. This disclosure provides for using natural (e.g., sand as) a low-cost, dissolvable material or aggregate for forming highly conductive propped fractures in certain (e.g., SAGD well or geothermal) well applications.

Via this disclosure, steam at high pH can be utilized to advantage to dissolve natural sand and/or man-made proppant for generating highly conductive propped fractures.

The methods of this disclosure can provide the ability to maintain fracture conductivity and prevent proppant flowback from fractures, which can help mitigate the downtime of operations and/or the number of workovers caused by damaged equipment.

ADDITIONAL DISCLOSURE

The following are non-limiting, specific embodiments in accordance with the present disclosure:

In a first embodiment, a method of forming (e.g., highly conductive) propped fractures in a subterranean formation penetrated by a wellbore comprises: injecting a fracturing fluid through a (e.g., geothermal, SAGD) wellbore into the subterranean formation, thus creating fractures in the subterranean formation, wherein the fracturing fluid comprises: a carrier fluid; aggregates; and dissolvable particulates (e.g., proppant, sand; that dissolves over time under downhole conditions, e.g., T≥230° C.), whereby the aggregates and dissolvable particulates are positioned in the created fractures; allowing the aggregates to cure into hardened masses (e.g., for functioning as pillars); and dissolving the dissolvable particulates, whereby voids and/or (e.g., solids-free) channels are formed in the (e.g., highly conductive) propped fractures, wherein the voids and/or channels (e.g., surround the solid masses and) provide pathways (e.g., for fluid to flow) through the (e.g., highly conductive) propped fractures (e.g., from the wellbore to another wellbore).

A second embodiment can include the method of the first embodiment, wherein the dissolvable particulates comprise (e.g., natural) sand.

A third embodiment can include the method of the first or the second embodiment, wherein the aggregates are selected from aggregates of fly ash composite, aggregates of geopolymer, or a combination thereof.

A fourth embodiment can include the method of the third embodiment, wherein the aggregates of fly ash composite comprise fly ash, cement, and a binding agent; wherein the aggregates of geopolymer comprise a geopolymer composition and a binding agent; or both wherein the aggregates of fly ash composite comprise fly ash, cement, and a binding agent and wherein the aggregates of geopolymer comprise a geopolymer composition and a binding agent.

A fifth embodiment can include the method of the fourth embodiment, wherein the binding agent comprises a flocculating agent ("flocculant"), a surface modification agent (a "surface modifier"), an adhesive material, a curing agent, or a combination thereof.

A sixth embodiment can include the method of the fifth embodiment, wherein the flocculating agent is selected from lime, calcium chloride, ferric chloride, aluminum sulfate, polyethylene glycol, polyacrylamide, polyamines, or a combination thereof.

A seventh embodiment can include the method of any one of the fourth to sixth embodiments, wherein the fly ash comprises ASTM Class C fly ash, ASTM Class F fly ash, or a combination thereof.

An eighth embodiment can include the method of any one of the third to seventh embodiments, wherein the geopolymer composition comprises an aluminosilicate (source), a metal silicate (source), and an activator.

A ninth embodiment can include the method of any one of the third to eighth embodiments further comprising forming the fly ash composite by combining the fly ash with cement, pozzolan, or a combination thereof.

A tenth embodiment can include the method of the ninth embodiment, wherein the cement comprises a Portland cement.

An eleventh embodiment can include the method of the ninth or the tenth embodiment, wherein forming the fly ash composite by combining the fly ash with cement, pozzolan, or the combination thereof further comprises combining the fly ash with cement, pozzolan, or the combination thereof and a binding agent.

A twelfth embodiment can include the method of the eleventh embodiment, wherein the binding agent is a curing agent selected from calcium hydroxide, sodium hydroxide, potassium hydroxide, sodium silicate, sulfuric acid, phosphoric acid, polyphosphoric acid, phosphoric acid precursor (e.g., orthophosphates, pyrophosphate, metaphosphate, polyphosphate), salts thereof (e.g., sodium dihydrogen phosphate, dipotassium hydrogen phosphate, tricalcium phosphate), or a combination thereof.

A thirteenth embodiment can include the method of any one of the first to twelfth embodiments, wherein the carrier fluid comprises a slick water or a gel (e.g., a crosslinked gel, a viscoelastic surfactant gel, an oil gel, a foamed gel, or an emulsion).

A fourteenth embodiment can include the method of any one of the first to thirteenth embodiments, wherein the propped fractures are highly conductive propped fractures that maintain porosity (flow) at closing pressures of greater than or equal to about 10000, 9000, 8000, 7000, 6000, 5000, or 4000 psi.

A fifteenth embodiment can include the method of any one of the first to fourteenth embodiments further comprising: carrying out a SAGD or geothermal process utilizing the wellbore.

A sixteenth embodiment can include the method of the fifteenth embodiment, wherein the dissolving the dissolvable particulates is effected at least in part during injection of steam during the SAGD process or during injection of steam or another heat exchange fluid into the wellbore during the geothermal process.

In a seventeenth embodiment, a method of forming (e.g., highly conductive) propped fractures in a subterranean formation penetrated by a wellbore comprises: providing an aggregate slurry and a dissolvable particulate (e.g., sand; dissolvable at downhole conditions, e.g., with time, temperature, steam) slurry; alternately (e.g., and/or intermittently) injecting volumes of the aggregate slurry and the dissolvable particulate slurry into the formation (e.g., via a (e.g., SAGD or geothermal wellbore)), whereby the aggregates and dissolvable particulates are positioned in created fractures; curing the aggregates into hardened masses (e.g., for functioning as pillars); and dissolving some or all of the dissolvable particulates to form voids and/or (e.g., solids-free) channels in the (e.g., highly conductive) propped fractures, wherein the voids and/or channels (e.g., surround the solid masses and) provide pathways (e.g., for fluid to flow) through the (e.g., highly conductive) propped fractures (e.g., from the wellbore to another wellbore).

An eighteenth embodiment can include the method of the seventeenth embodiment, wherein the dissolvable particulates comprise (e.g., natural) sand.

A nineteenth embodiment can include the method of the seventeenth embodiment, wherein the aggregates are selected from aggregates of fly ash composite, aggregates of geopolymer, or a combination thereof.

A twentieth embodiment can include the method of the nineteenth embodiment, wherein the aggregates of fly ash composite comprise fly ash, cement, and a binding agent; wherein the aggregates of geopolymer comprise a geopolymer composition and a binding agent; or both wherein the aggregates of fly ash composite comprise fly ash, cement, and a binding agent and wherein the aggregates of geopolymer comprise a geopolymer composition and a binding agent.

A twenty first embodiment can include the method of the twentieth embodiment, wherein the binding agent comprises a flocculating agent ("flocculant"), a surface modification agent (a "surface modifier"), an adhesive material, a curing agent, or a combination thereof.

A twenty second embodiment can include the method of the twenty first embodiment, wherein the flocculating agent is selected from lime, calcium chloride, ferric chloride, aluminum sulfate, polyethylene glycol, polyacrylamide, polyamines, or a combination thereof.

A twenty third embodiment can include the method of any one of the twentieth to twenty second embodiments, wherein the fly ash comprises ASTM Class C fly ash, ASTM Class F fly ash, or a combination thereof.

A twenty fourth embodiment can include the method of any one of the nineteenth to twenty third embodiments, wherein the geopolymer composition comprises an aluminosilicate (source), a metal silicate (source), and an activator.

A twenty fifth embodiment can include the method of any one of the nineteenth to twenty fourth embodiments further comprising forming the fly ash composite by combining the fly ash with cement, pozzolan, or a combination thereof.

A twenty sixth embodiment can include the method of the twenty fifth embodiment, wherein the cement comprises a Portland cement.

A twenty seventh embodiment can include the method of the twenty fifth or twenty sixth embodiment, wherein forming the fly ash composite by combining the fly ash with cement, pozzolan, or the combination thereof further comprises combining the fly ash with cement, pozzolan, or the combination thereof and a binding agent.

A twenty eighth embodiment can include the method of the twenty seventh embodiment, wherein the binding agent is a curing agent selected from calcium hydroxide, sodium hydroxide, potassium hydroxide, sodium silicate, sulfuric acid, phosphoric acid, polyphosphoric acid, phosphoric acid precursor (e.g., orthophosphates, pyrophosphate, metaphosphate, polyphosphate), salts thereof (e.g., sodium dihydrogen phosphate, dipotassium hydrogen phosphate, tricalcium phosphate), or a combination thereof.

A twenty ninth embodiment can include the method of any one of the seventeenth to twenty eighth embodiments, wherein the aggregate slurry further comprises a carrier fluid that comprises a slick water or a gel (e.g., a crosslinked gel, a viscoelastic surfactant gel, an oil gel, a foamed gel, or an emulsion).

A thirtieth embodiment can include the method of any one of the seventeenth to twenty ninth embodiments, wherein the propped fractures are highly conductive propped fractures that maintain porosity (flow) at closing pressures of greater than or equal to about 10000, 9000, 8000, 7000, 6000, 5000, or 4000 psi.

A thirty first embodiment can include the method of any one of the seventeenth to thirtieth embodiments further comprising: carrying out a SAGD or geothermal process utilizing the wellbore.

A thirty second embodiment can include the method of the thirty first embodiment, wherein the dissolving the some or all of the dissolvable particulates is effected at least in part during injection of steam during the SAGD process or during injection of steam or another heat exchange fluid into the wellbore during the geothermal process.

In a thirty third embodiment, a method of forming (e.g., highly conductive) propped fractures in a subterranean formation penetrated by a wellbore comprises: injecting a fracturing fluid comprising a carrier fluid and aggregates into the subterranean formation (e.g., via a (e.g., SAGD or geothermal) wellbore) whereby propped fractures are created; wherein the fracturing fluid comprises from about 0.1 to about 0.5, from about 0.1 to about 0.4, or from about 0.1 to about 0.3 pounds per gallon of the aggregates, and wherein the aggregates (are clusters of micro-proppants that) have a size (e.g., a median size, a volume average size, a D50) of greater than or equal to about 20, 100, or 1,000 micrometers (μm); and wherein the aggregates accumulate at fracture points and/or points of leak-off (e.g., such as fracture throats or natural fractures in the rock) of the subterranean formation; and allowing the aggregates to cure (e.g., into hardened masses).

A thirty fourth embodiment can include the method of the thirty third embodiment, wherein the fracturing fluid further comprises dissolvable particulates (e.g., proppant, sand) having a size (a volume average size) of greater than or equal to about 50, 100, or 1,000 micrometers (μm).

A thirty fifth embodiment can include the method of the thirty fourth embodiment further comprising dissolving some or all of the dissolvable particulates to form voids and/or (e.g., solids-free) channels in the (e.g., highly conductive) propped fractures, wherein the voids and/or channels (e.g., surround the solid masses and) provide pathways for fluid to flow through the (e.g., highly conductive) propped fractures (e.g., from the wellbore to another wellbore).

A thirty sixth embodiment can include the method of the thirty fourth or thirty fifth embodiments, wherein the dissolvable particulates comprise (e.g., natural) sand.

A thirty seventh embodiment can include the method of the thirty fifth or thirty sixth embodiment, wherein dissolving the dissolvable particulates is effected at least in part during injection of steam during a SAGD process or during injection of steam or another heat exchange fluid into the wellbore during a geothermal process.

A thirty eighth embodiment can include the method of any one of the thirty third to thirty seventh embodiments, wherein the aggregates are selected from aggregates of fly ash composite, aggregates of geopolymer, or a combination thereof.

A thirty ninth embodiment can include the method of the thirty eighth embodiment, wherein the aggregates of fly ash composite comprise fly ash, cement, and a binding agent; wherein the aggregates of geopolymer comprise a geopolymer composition and a binding agent; or both wherein the aggregates of fly ash composite comprise fly ash, cement, and a binding agent and wherein the aggregates of geopolymer comprise a geopolymer composition and a binding agent.

A fortieth embodiment can include the method of the thirty ninth embodiment, wherein the binding agent comprises a flocculating agent ("flocculant"), a surface modification agent (a "surface modifier"), an adhesive material, a curing agent, or a combination thereof.

A forty first embodiment can include the method of the fortieth embodiment, wherein the flocculating agent is selected from lime, calcium chloride, ferric chloride, aluminum sulfate, polyethylene glycol, polyacrylamide, polyamines, or a combination thereof.

A forty second embodiment can include the method of any one of the thirty ninth to forty first embodiments, wherein the fly ash comprises ASTM Class C fly ash, ASTM Class F fly ash, or a combination thereof.

A forty third embodiment can include the method of any one of the thirty eighth to forty second embodiments, wherein the geopolymer composition comprises an aluminosilicate (source), a metal silicate (source), and an activator.

A forty fourth embodiment can include the method of any one of the thirty eighth to forty third embodiments further comprising forming the fly ash composite by combining the fly ash with cement, pozzolan, or a combination thereof.

A forty fifth embodiment can include the method of the forty fourth embodiment, wherein the cement comprises a Portland cement.

A forty sixth embodiment can include the method of the forty fourth embodiment, wherein forming the fly ash composite by combining the fly ash with cement, pozzolan, or the combination thereof further comprises combining the fly ash with cement, pozzolan, or the combination thereof and a binding agent.

A forty seventh embodiment can include the method of the forty sixth embodiment, wherein the binding agent is a curing agent selected from calcium hydroxide, sodium hydroxide, potassium hydroxide, sodium silicate, sulfuric acid, phosphoric acid, polyphosphoric acid, phosphoric acid precursor (e.g., orthophosphates, pyrophosphate, metaphosphate, polyphosphate), salts thereof (e.g., sodium dihydrogen phosphate, dipotassium hydrogen phosphate, tricalcium phosphate), or a combination thereof.

A forty eighth embodiment can include the method of any one of the thirty third to forty seventh embodiments, wherein the carrier fluid comprises a slick water or a gel (e.g., a crosslinked gel, a viscoelastic surfactant gel, an oil gel, a foamed gel, or an emulsion).

A forty ninth embodiment can include the method of any one of the thirty third to forty eighth embodiments, wherein the propped fractures are highly conductive propped fractures that maintain porosity (flow) at closing pressures of greater than or equal to about 10000, 9000, 8000, 7000, 6000, 5000, or 4000 psi.

A fiftieth embodiment can include the method of any one of the thirty third to forty ninth embodiments further comprising: carrying out a SAGD or geothermal process utilizing the wellbore.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru—Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of forming propped fractures in a subterranean formation penetrated by a wellbore, comprising:

injecting a fracturing fluid through a wellbore into the subterranean formation, thus creating fractures in the subterranean formation, wherein the fracturing fluid comprises:

a carrier fluid;

aggregates, wherein the aggregates comprise a combination of aggregates of fly ash composite and aggregates of geopolymer; and dissolvable particulates, whereby the aggregates and dissolvable particulates are positioned in the created fractures;

allowing the aggregates to cure into hardened masses; and dissolving the dissolvable particulates, whereby voids and/or channels are formed in the propped fractures, wherein the voids and/or channels provide pathways through the propped fractures.

2. The method of claim 1, wherein the dissolvable particulates comprise sand.

3. The method of claim 1, wherein the aggregates of fly ash composite comprise fly ash, cement, and a binding agent; wherein the aggregates of geopolymer comprise a geopolymer composition and a binding agent; or both wherein the aggregates of fly ash composite comprise fly ash, cement, and a binding agent and wherein the aggregates of geopolymer comprise a geopolymer composition and a binding agent.

4. The method of claim 2, wherein the geopolymer composition comprises an aluminosilicate, a metal silicate, and an activator.

5. The method of claim 3, wherein the aggregates of fly ash composite comprise the fly ash, the cement, and the binding agent.

6. The method of claim 5, wherein the aggregates of geopolymer comprise the geopolymer composition and the binding agent.

7. The method of claim 1, wherein the carrier fluid comprises a slick water or a gel.

8. The method of claim 1, wherein the propped fractures are highly conductive propped fractures that maintain porosity at closing pressures of greater than or equal to about 4000 psi.

9. The method of claim 1 further comprising:

injecting steam into the wellbore during a SAGD process or injecting steam or another heat exchange fluid into the wellbore during a geothermal process.

10. The method of claim 1, wherein a majority of the dissolvable particulates comprise sand, silica, or a combination thereof.

* * * * *